US005743627A

United States Patent [19]

Casteel

[11] Patent Number: 5,743,627

[45] Date of Patent: Apr. 28, 1998

[54] LIGHTING FIXTURE

[76] Inventor: Joseph M. Casteel, 255 Lylton Rd., Moon Township, Pa. 15108

[21] Appl. No.: 805,925

[22] Filed: Feb. 25, 1997

[51] Int. Cl.[6] ..... F21V 23/00; F21S 3/00

[52] U.S. Cl. ..... 362/222; 362/221; 362/225; 362/260

[58] Field of Search ..... 362/217, 221, 362/222, 223, 224, 225, 260, 367, 249, 237, 240, 267

[56] References Cited

U.S. PATENT DOCUMENTS

| | | | |
|---|---|---|---|
| 4,403,275 | 9/1983 | Oser | 362/225 |
| 4,799,134 | 1/1989 | Pinch et al. | 362/217 |
| 4,933,820 | 6/1990 | Engel | 362/217 |
| 5,183,327 | 2/1993 | Fabbri | 362/219 |
| 5,440,466 | 8/1995 | Belisle et al. | 362/222 |
| 5,479,327 | 12/1995 | Chen | 362/222 |

*Primary Examiner*—Thomas M. Sember
*Attorney, Agent, or Firm*—Carothers & Carothers

[57] ABSTRACT

A low profile damage resistant lighting fixture which has a substantially rigid extruded housing base with an elongated back plate and a spaced pair of longitudinally extending legs that depend from an inside surface of the back plate and thereby provide a ballast channel between the legs and a pair of lamp channels on opposite sides of the ballast channel to receive elongated florescent lamps. An elongated cover is removably secured with snap connections to the legs for covering the ballast channel. Cast or molded end caps enclose opposite ends of the fixture.

17 Claims, 3 Drawing Sheets

LIGHTING FIXTURE

BACKGROUND OF THE INVENTION

The present invention pertains generally to a lighting fixture and more particularly to a low profile, damage resistant, efficient florescent fixture specifically designed to meet military and industrial requirements and standards.

Present day florescent lighting fixtures are not suitable for many military and industrial applications and requirements. They are too thick in profile and therefore do not provide sufficient clearance and are not suitable for low head room conditions. In addition, they are constructed of many stamped sheet metal parts and are therefore not sufficiently resistant to damage, making them unsuitable for cabinet and shelving storage systems, under walkway installation, use in vans and storage trailers, recreational vehicles, emergency vehicles and military vans and for under shelf and work stations in military and industrial installations.

It is a principal object of the present invention to provide a lighting fixture which is low profile, extremely resistant to damage and better suited for the needs and requirements of military and industrial applications.

SUMMARY OF THE INVENTION

The lighting fixture of the present invention is comprised of a substantially rigid housing base that has an elongated back plate with a spaced pair of longitudinally extending legs that depend from the same inside surface of this back plate to provide a ballast channel between the extending legs. A pair of lamp channels are also thereby provided on opposite sides of this ballast channel to respectively receive elongated florescent lamps. An elongated cover is removably secured to the legs for covering the ballast channel.

The base and cover are preferably extruded of aluminum and the legs on the back plate therefore substantially coextend with the back plate. The extruded cover then attaches to these legs with longitudinal snap connections for simple and easy assembly and disassembly, thereby providing a strong basic lighting fixture housing of two pieces.

These pieces of course could be extruded of a suitable plastic such as ABS, but aluminum is preferred for its strength and heat and electrical conducting capabilities.

Lenses are also preferably provided and removably enclose the lamp channels to cover over the elongated florescent tube lamps contained therein and to more efficiently defuse the light emanating from the fixture. The lenses are preferably made of non-yellowing acrylic, which is specially compounded and extruded and provides impact and crack resistance.

The elongated lenses snap fit into the fixture in a conventional manner. The lenses are also provided with elastic end seals secured to the end caps for sealing the ends of the lens with the fixture thereby preventing access of dust into the fixture.

The fixture of the present invention may be suitably wired for 115 volt AC or 12 or 24 volt DC or they may be optionally wired for dual voltage applications. The fixtures are also suitable for prewiring for easy hookup without the requirement of having to open each fixture when the installation process is carried out.

Dual voltage application is easily made possible by the use of an invertor in the housing, which may be mounted in the ballast channel along with the lamp ballast.

Opposite ends of the fixture are closed off with end caps. These end caps include conduit connector ports for passing electrical wires therethrough and for also threadably receiving connecting conduit connectors or plug type wire connectors etc.

The end caps are also preferably provided with guide protrusions for self aligning engagement of the end caps with the fixture ends. The end caps may be cast of aluminum or suitable plastic. Again, aluminum is preferred for the reasons given hereinbefore.

BRIEF DESCRIPTION OF THE DRAWINGS

Other objects and advantages appear hereinafter in the following description and claims. The drawings show for the purpose of exemplification, without limiting the invention or the appended claims, certain practical embodiments of the invention wherein:

DETAILED DESCRIPTION OF A PREFERRED EMBODIMENT

Figure 1:
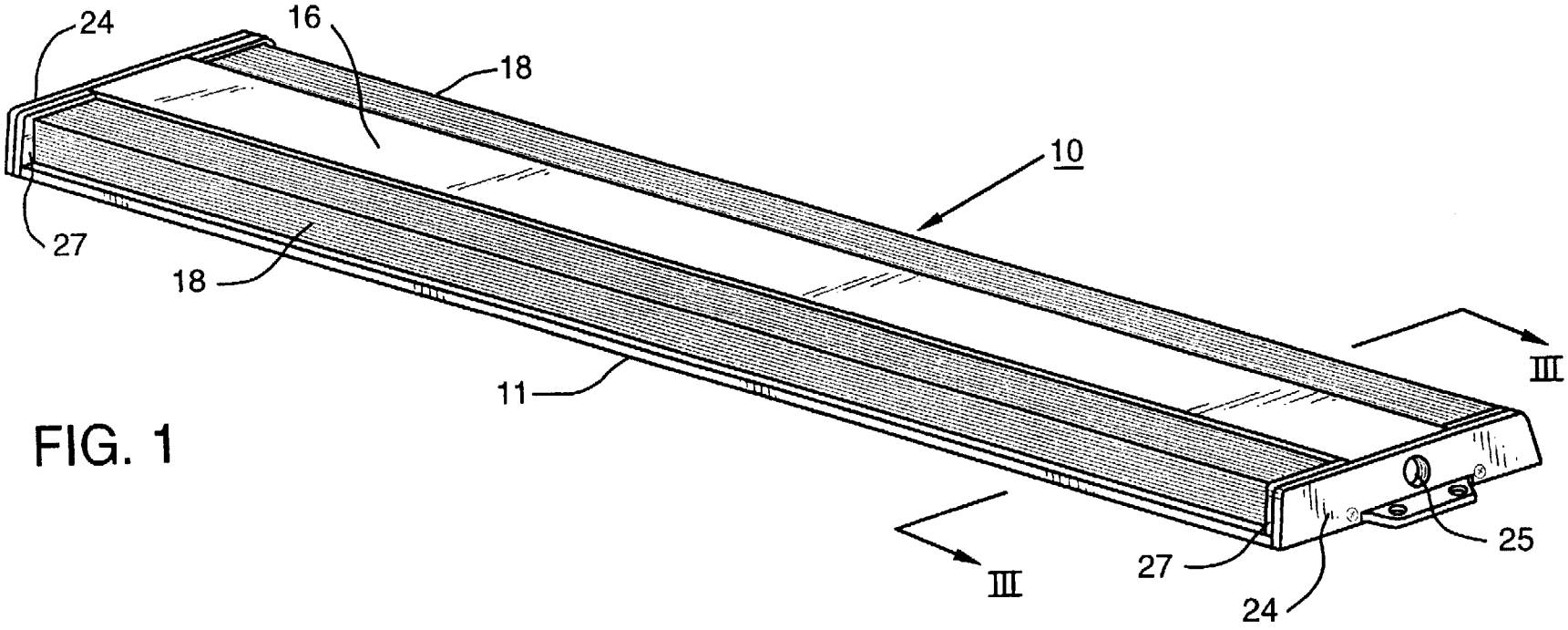
FIG. 1 is a perspective external view of a preferred embodiment of the lighting fixture of the present invention.
Figure 2:
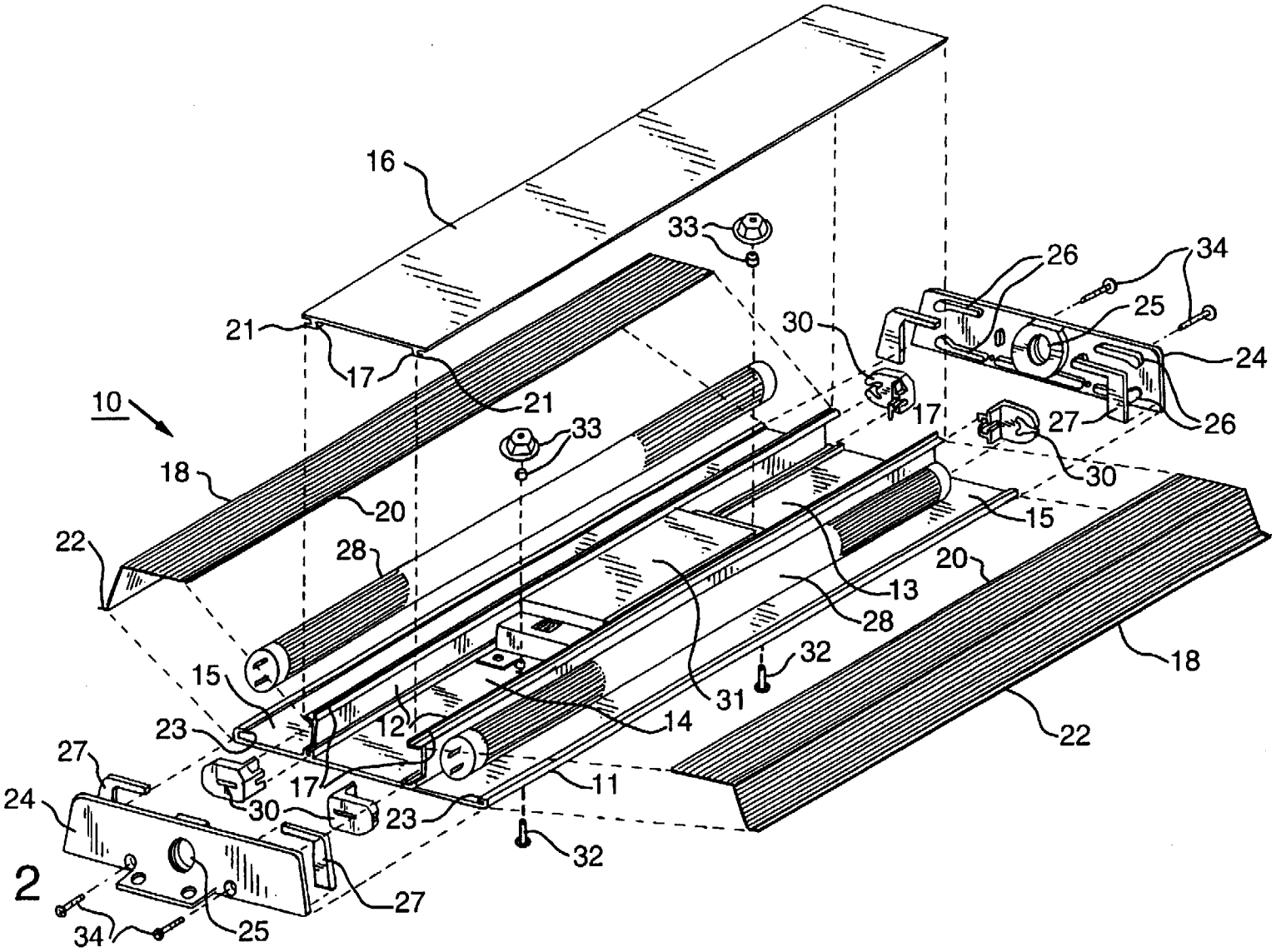
FIG. 2 is an exploded or expanded perspective view of the light fixture shown in FIG. 1 illustrating the detail of the internal parts of the fixture and their interrelationship for assembly.
Figure 3:
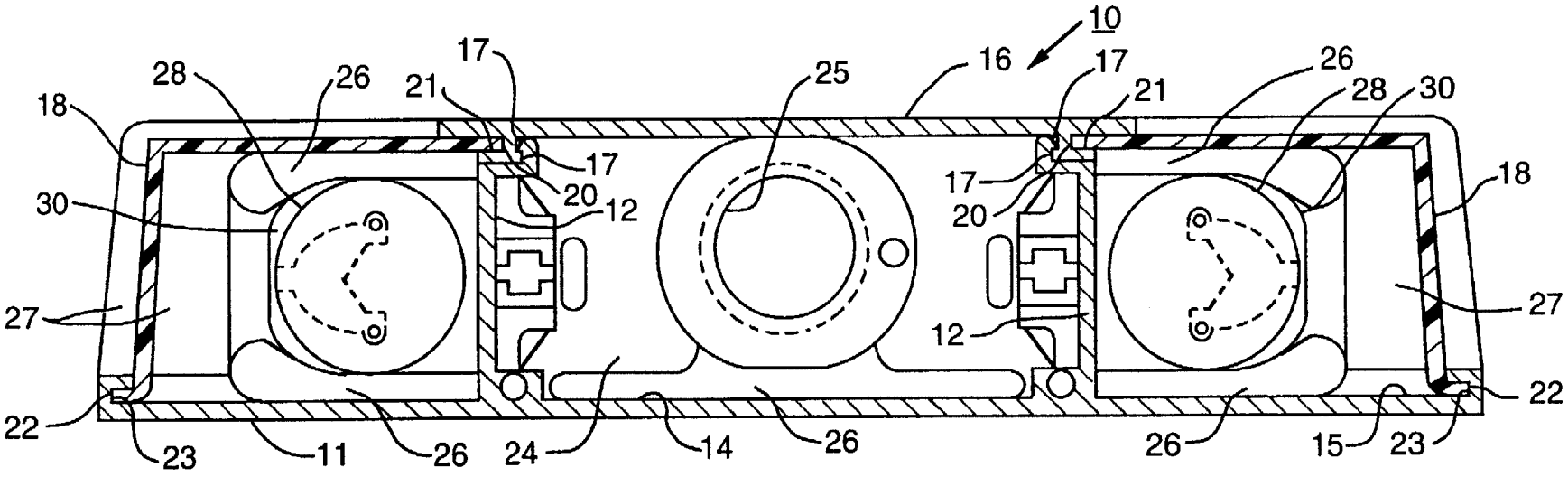
FIG. 3 is a sectional view of the fixture shown in FIG. 1 as seen along section line III—III.

Referring to the drawings, the light fixture 10 of the present invention includes a substantially rigid housing base 11 of extruded aluminum with a spaced pair of longitudinally extending legs 12 that depend from inside surface 13 of back plate 11 thereby providing ballast channel 14 therebetween. A pair of lamp channels 15 are provided on opposite sides of ballast channel 14.

Elongated cover 16 of extruded aluminum it is easily secured to legs 12 with longitudinal snap connections 17.

Elongated acrylic light diffusing lenses 18 removably enclose lamp channels 15. Lenses 18 are sufficiently flexible to snap fit into the fixture housing whereby the lens inner edges 20 respectively engaged into the lens edge channels 21 of cover 16 and their outer end edges 22 are respectively received in the outer lens edge channels 23 provided on the outside edges of extruded back plate 15.

End caps 24 of cast aluminum enclose opposite ends of the fixture 10. End caps 24 are further provided with conduit connector parts 25 for passing electrical wires therethrough and for threadably connecting conventional conduit connectors or electrical plug connections.

End caps 24 are also provided with guide protrusions 26 which are prearranged in their casting for self alignment or self aligning engagement of the end caps 24 on the fixture ends.

Elastic lens end seals 27 are secured or glued to the insides of end caps 24 for sealing the ends of lenses 18 with the fixture 10.

Florescent lamps 28 are conventional T8 lamps which are wired into the fixture housing in conventional fashion with lamp end sockets 30 and energized with a conventional ballast 31. In order to provide minimum profile of fixture 10, ballast 31 is a very thin (1.25") electronic ballast manufactured by Motorolla®. The actual wiring of the ballast 31 and lamp end sockets 30 is not illustrated in order to minimize confusion in the drawings. However, the lamps are connected in a conventional well known manner for AC or DC applications or for dual voltage applications.

Ballast 31 is connected to back plate 15 by conventional machine screws 32 in combination with hex nut and lock nut combinations 33. Similarly, end caps 24 and lamp sockets 30 are connected to fixture housing base 11 with sheet metal screws 34.

The basic structure of fixture 10 is a simple two piece extruded aluminum combination of base 11 and cover 16 which conveniently snap together and provide not only a simple but extremely strong housing structure that can take considerable abuse and will not readily bend or deform as do the stamped sheet metal housings of the prior art. The result is a strong light weight housing.

The fixture 10 is also of extremely narrow or low profile and generally will have a height or thickness of only one and 7/16" and a width of only 7". The length of the fixture 10 is of course variable for standard size florescent fixtures e.g. 48", 36" and 24".

The fixture 10 is also well sealed as before indicated and is also therefore suitable for damp locations and is also suitable for dual voltage hookup such as 115 VAC/12 VDC or 115 VAC/24 VDC.

The fixture 10 may also be provided with conventional on off switches for under shelf or work station applications and they may also be prewired with plug-in cords.

The fixture 10 is also very much suited for applications wherein the fixture will be subject to considerable flexing, such as in military vans or for mounting under metal walkways.

I claim:

1. A lighting fixture comprising: a substantially rigid housing base having an elongated back plate with a spaced pair of longitudinally extending legs depending from an inside surface of said back plate and providing a ballast channel therebetween and a pair of lamp channels on opposite sides of said ballast channel, and an elongated cover removably secured to said legs with longitudinal snap connections for covering said ballast channel and thereby providing a strong two-piece housing assembly.

2. The lighting fixture of claim 1 including lenses removably enclosing said lamp channels.

3. The lighting fixture of claim 2 including end caps enclosing opposite ends of the fixture.

4. The lighting fixture of claim 3 wherein said end caps include conduit connector ports for passing electrical wires therethrough and for threadably connecting conduit connectors.

5. The lighting fixture of claim 4 wherein said end caps include guide protrusions for self aligning engagement of said end caps on the fixture ends.

6. The lighting fixture of claim 5 wherein said end caps are cast of aluminum.

7. The lighting fixture of claim 4 wherein said end caps are molded of plastic.

8. The lighting fixture of claim 2 wherein said base is an extruded unit.

9. The lighting fixture of claim 8 wherein said legs substantially coextend with said back plate.

10. The lighting fixture of claim 9 wherein said cover is an extruded unit.

11. The lighting fixture of claim 10 wherein said lenses are acrylic.

12. The lighting fixture of claim 11 wherein said lenses snap fit into the fixture.

13. The lighting fixture of claim 12 including elastic lens end seals secured to said end caps for sealing the ends of said lenses with the fixture.

14. The lighting fixture of claim 10 including florescent lamps mounted in said lamp channels and a lamp ballast mounted in said ballast channel and electrically connected to said lamps for illumination thereof when said ballast is electrically energized.

15. The lighting fixture of claim 14 including end caps enclosing opposite ends of the fixture.

16. The lighting fixture of claim 14 wherein said end caps include conduit connector ports for passing electrical wires therethrough and for threadably connecting a conduit connector.

17. The lighting fixture of claim 16 wherein said end caps include guide protrusions for self aligning engagement of said end caps on the fixture ends.

* * * * *